US008518238B2

(12) United States Patent
Link et al.

(10) Patent No.: US 8,518,238 B2
(45) **Date of Patent: *Aug. 27, 2013**

(54) PROCESSES FOR INHIBITING FOULING IN HYDROCARBON PROCESSING

(75) Inventors: John Link, Humble, TX (US); Zen-Yu Chang, Conroe, TX (US)

(73) Assignee: General Electric Company, Schenectady, NY (US)

( * ) Notice: Subject to any disclaimer, the term of this patent is extended or adjusted under 35 U.S.C. 154(b) by 498 days.

This patent is subject to a terminal disclaimer.

(21) Appl. No.: 12/421,181

(22) Filed: Apr. 9, 2009

(65) Prior Publication Data

US 2010/0258480 A1 Oct. 14, 2010

(51) Int. Cl.
*C10G 75/04* (2006.01)

(52) U.S. Cl.
USPC ..... 208/48 AA

(58) Field of Classification Search
USPC ..... 203/6, 7, 8, 9; 208/48 AA; 570/103, 570/222, 262
See application file for complete search history.

(56) References Cited

U.S. PATENT DOCUMENTS

| | | | | |
|---|---|---|---|---|
| 4,107,030 | A | 8/1978 | Slovinsky et al. | |
| 4,319,063 | A | 3/1982 | Dvoracek et al. | |
| 4,390,412 | A | 6/1983 | Dvoracek et al. | |
| 4,440,625 | A | 4/1984 | Go et al. | |
| 4,673,489 | A | 6/1987 | Roling | |
| 4,902,824 | A | 2/1990 | Syrinek | |
| 4,952,301 | A | 8/1990 | Awbrey | |
| 5,173,213 | A * | 12/1992 | Miller et al. | 252/394 |
| 5,194,143 | A | 3/1993 | Roling | |
| 5,220,104 | A | 6/1993 | McDaniel et al. | |
| 5,446,233 | A | 8/1995 | Lewis et al. | |
| 5,650,072 | A | 7/1997 | McClain et al. | |
| 5,710,329 | A | 1/1998 | Clever | |
| 5,746,924 | A | 5/1998 | Cooper et al. | |
| 7,125,483 | B2 * | 10/2006 | Haynal | 208/47 |
| 2004/0072974 | A1 | 4/2004 | Tong | |
| 2010/0243537 | A1 * | 9/2010 | King et al. | 208/48 AA |

FOREIGN PATENT DOCUMENTS

| | | | |
|---|---|---|---|
| EP | 0225692 | A1 | 6/1987 |
| EP | 266872 | A1 | 5/1988 |
| EP | 267673 | A1 | 5/1988 |
| EP | 267674 | A1 | 5/1988 |
| EP | 644250 | A1 | 3/1995 |
| EP | 839790 | A1 | 5/1998 |
| EP | 872475 | A2 | 10/1998 |

OTHER PUBLICATIONS

The PCT International Search Report and Written Opinion issued in connection with corresponding International Application No. PCT/US2010/025406 on Mar. 3, 2011.

* cited by examiner

*Primary Examiner* — Brian McCaig
(74) *Attorney, Agent, or Firm* — Wegman, Hessler & Vanderburg

(57) ABSTRACT

A method for inhibiting the formation of fouling materials during hydrocarbon processing is provided. Hydrocarbon media, which is undergoing treatment with a basic wash and contains carbonyl compounds is contacted with hydroxylamine and naphthalene sulfonate to inhibit the formation of fouling materials and to minimize the deposition of fouling compounds that may occur during hydrocarbon processing.

19 Claims, No Drawings

PROCESSES FOR INHIBITING FOULING IN HYDROCARBON PROCESSING

FIELD OF THE INVENTION

This invention relates to methods for reducing fouling in hydrocarbon processing and more particularly, to reducing aldol polymer fouling in hydrocarbon processing.

BACKGROUND OF THE INVENTION

Olefin compounds, such as ethylene, propylene, butylene and amylene, can be formed from pyrolytic cracking of light petrochemicals. During the cracking process, secondary reactions may also occur producing carbonyl compounds, such as aldehydes and ketones. As a result, the cracked hydrocarbon product stream can also contain significant quantities of aldehydes and ketones.

The cracked hydrocarbon product stream is cooled to remove most of the heavier hydrocarbons, compressed and then treated with a basic wash (pH>7) to remove contaminating acidic compounds, such as hydrogen sulfide and carbon dioxide. When the hydrocarbon stream is passed through the basic wash, the carbonyl compounds, particularly aldehydes, will undergo polymerization in the presence of a base to form condensation polymers known as aldol polymers or red oil. Aldol polymers are essentially insoluble in the basic wash and the hydrocarbon media and deposit on the internal surfaces of process equipment. These deposits can restrict flow through the equipment, which causes the pressure drop to increase across the treating vessel, resulting in a loss of capacity and increased operating costs. If left untreated, the deposition from the fouling components can result in the premature shutdown of a cracking operation.

Although carbonyl scavengers and dispersants are available for removing or inhibiting aldol formation, it would be desirable to have an improved and more economical process for inhibiting the formation of fouling materials and minimizing the deposition of fouling compounds during hydrocarbon processing.

SUMMARY OF THE INVENTION

In one embodiment, a method for inhibiting the formation of fouling materials including contacting hydrocarbon media containing carbonyl compounds with hydroxylamine and naphthalene sulfonate while treating the hydrocarbon media with a basic wash.

The various embodiments provide improved and economical methods for reducing aldol formation and inhibiting fouling in petrochemical processing.

DETAILED DESCRIPTION OF THE INVENTION

The singular forms "a," "an" and "the" include plural referents unless the context clearly dictates otherwise. The endpoints of all ranges reciting the same characteristic are independently combinable and inclusive of the recited endpoint. All references are incorporated herein by reference.

The modifier "about" used in connection with a quantity is inclusive of the stated value and has the meaning dictated by the context (e.g., includes the tolerance ranges associated with measurement of the particular quantity).

"Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present.

In one embodiment, a method for inhibiting the formation of fouling materials including contacting hydrocarbon media containing carbonyl compounds with hydroxylamine and naphthalene sulfonate while treating the hydrocarbon media with a basic wash.

In one embodiment, the hydroxylamine may be in the form of its hydrates or salts. The salts may be derived from a mineral acid, such as sulfuric acid, hydrochloric acid or nitric acid, or from an organic acid, such as acetic acid or propanoic acid. In another embodiment, the hydroxylamine may be hydroxylamine sulfate, hydroxylamine sulfite, hydroxylamine acetate, hydroxylamine nitrate or hydroxylamine hydrochloride.

Naphthalene sulfonate is commercially available as DAXAD® 14C from Hampshire Chemical Company. In one embodiment, the naphthalene sulfonate may be in the form of its condensates or salts.

In one embodiment, the weight ratio of the hydroxylamine to naphthalene sulfonate may be from about 0.1:1 to about 20:1. In another embodiment, the weight ratio of the hydroxylamine to naphthalene sulfonate may be from about 0.1:1 to about 10:1. In another embodiment, the weight ratio may be from about 0.4:1 to about 5:1. In another embodiment, the weight ratio may be from about 1:1 to about 10:1. In another embodiment, the weight ratio of the hydroxylamine to naphthalene sulfonate may be from about 1:1 to about 8:1.

The amount of hydroxylamine and naphthalene sulfonate may contact the hydrocarbon media in any amount effective for reducing aldol fouling. In one embodiment, the combined dosage amount for hydroxylamine and naphthalene sulfonate may be from about 0.1 ppm by weight to about 1000 ppm by weight based on the weight of the hydrocarbon media. In another embodiment, the combined dosage amount may be from about 1 ppm by weight to about 100 ppm by weight, based on the weight of the hydrocarbon media. In another embodiment, the combined dosage amount may be from about 1 ppm by weight to about 50 ppm by weight, based on the weight of the hydrocarbon media.

In one embodiment, the hydroxylamine may be added in solution. In one embodiment, the hydroxylamine is added as an aqueous solution with 2 to 50 weight percent of the hydroxylamine present. In another embodiment, the hydroxylamine is added as an aqueous solution with 2 to 25 weight percent of the hydroxylamine.

In one embodiment, the naphthalene sulfonate may be added in solution. In one embodiment, the naphthalene sulfonate is added as an aqueous solution with 2 to 50 weight percent of the naphthalene present. In another embodiment, the naphthalene sulfonate is added as an aqueous solution with 2 to 25 weight percent of the naphthalene sulfonate.

In one embodiment, the hydroxylamine may be added to the hydrocarbon media simultaneously with the basic wash. In another embodiment, the hydroxylamine may be added to the basic wash before contacting the hydrocarbon media.

In one embodiment, the naphthalane sulfonate may be added to the hydrocarbon media simultaneously with the basic wash. In another embodiment, the naphthalene sulfonate may be added to the basic wash before contacting the hydrocarbon media.

In one embodiment, the hydroxylamine may be added in a batch or continuously. In one embodiment, the naphthalene sulfonate may be added in a batch or continuously.

The hydrocarbon media may be any type of hydrocarbon media. In one embodiment, the hydrocarbon media may be a cracked hydrocarbon stream from the pyrolysis of hydrocarbons, such as petrochemicals. In one embodiment, the petrochemicals are pyrolytically cracked at a temperature of up to about 1700° F. In another embodiment, the petrochemicals are pyrolytically cracked at a temperature in the range of from about 1550° F. to about 1670° F. In one embodiment, the cracked hydrocarbon stream is from the pyrolysis of ethane, propane, butane, naphtha, gasoil or mixtures thereof. In another embodiment, the olefinic compounds include, but are not limited to, ethylene, propylene, butadiene, amylene or mixtures thereof.

The carbonyl compounds may be any type of compound having a functional group containing a carbon double-bonded to an oxygen atom and may include aldehydes and ketones. The hydrocarbon media may contain any amount of carbonyl compounds. In one embodiment, the concentration of carbonyl compounds in the hydrocarbon media will range from about 0.5 ppm to about 500 ppm. In another embodiment, the carbonyl compounds are present in the hydrocarbon media in an amount of from about 1 ppm to about 100 ppm. In another embodiment, the carbonyl compounds are present in the hydrocarbon media in an amount of from about 5 ppm to about 50 ppm.

The hydrocarbon media is treated with a basic wash. The basic wash may be any alkaline wash having a pH of greater than 7.0. In one embodiment, the basic wash is a caustic wash. In another embodiment, the basic wash includes sodium hydroxide, potassium hydroxide or alkanolamine.

The hydrocarbon media may be washed by any suitable method or means for contacting the hydrocarbon media with a basic solution. In one embodiment, the hydrocarbon media is contacted with the basic wash in trayed or packed columns.

In one embodiment, a caustic stream is introduced into an upper portion of a caustic wash system and the hydrocarbon media is introduced into a lower portion. The caustic introduced into the caustic wash system flows downwardly through the vessel while the hydrocarbon media flows upwardly through the caustic wash system, whereby the hydrocarbon media is intimately contacted with the caustic.

In order that those skilled in the art will be better able to practice the present disclosure, the following examples are given by way of illustration and not by way of limitation.

EXAMPLES

Example 1

Sample bottles were prepared with 19.75 ml of a 20% NaOH. Various treatments (as shown in Table 1) were added to different sample bottles and the bottles were shaken to mix well. One sample bottle was used as a blank and no treatment was added. 0.25 ml of a 50% wt/wt solution of acetaldehyde in deionized water was added and the mixture was shaken well to thoroughly mix. The sample bottles were allowed to stand at room temperature and observations were recorded at various times. The effect of the treatments on fouling was assessed by color change and cloudiness in the solutions. Results are shown in Table 2.

TABLE 1

| Sample | 20% NaOH (ml) | 50% Acetaldehyde (ml) | Hydroxylamine Sulfate (ppm) | Naphthalene Sulfate[1] (ppm) | Dispersant (7500 ppm) |
|---|---|---|---|---|---|
| Blank | 19.75 | 0.25 | 0 | 0 | |
| CE-1 | 19.75 | 0.25 | 7500 | 0 | |
| CE-2 | 19.75 | 0.25 | 15,000 | 0 | |
| 1 | 19.75 | 0.25 | 11,250 | 2900 | |
| 2 | 19.75 | 0.25 | 10,000 | 3865 | |
| 3 | 19.75 | 0.25 | 7500 | 5800 | |
| 4 | 19.75 | 0.25 | 5625 | 725 | |
| 5 | 19.75 | 0.25 | 5625 | 1450 | |
| 6 | 19.75 | 0.25 | 5000 | 7730 | |
| 7 | 19.75 | 0.25 | 3750 | 8700 | |
| 8 | 19.75 | 0.25 | 3750 | 2900 | |
| 9 | 19.75 | 0.25 | 3750 | 1875 | |
| CE-3 | 19.75 | 0.25 | 0 | 7500 | |
| CE-4 | 19.75 | 0.25 | 0 | 11,600 | |
| CE-5 | 19.75 | 0.25 | | | EAPF[2] |
| CE-6 | 19.75 | 0.25 | | | EO/PO[3] |
| CE-7 | 19.75 | 0.25 | | | AA[4] |

[1]Naphthalene sulfonate was obtained commercially as DAXAD ® 14C from Hampshire Chemical Corp.
[2]EAPF is an ethoxylated alkylphenol formaldehyde resin.
[3]EO/PO is an ethylene oxide/propylene oxide polyol.
[4]AA is an amido-amide cationic dispersant.

TABLE 2

| Sample | 1-3 hours | 21-23 hours | 31-36 hours | 70+ hours |
|---|---|---|---|---|
| Blank | Fouled immediately -- Cloudy | N/A | N/A | N/A |
| CE-1 | At 1 hour, slightly opaque. At 3 hours, opaque. | N/A | N/A | At 72 hours, fouling material floating on top of sample. |
| CE-2 | N/A | At 21 hours, slightly fouled. At 23 hours, slightly cloudy. | N/A | At 90 hours, fouling material floating on surface. |
| 1 | Clear | Clear | At 31 hours, can see through sample. | At 90 hours, small amount of fouling material floating in sample. |
| 2 | Clear | Clear | At 31 hours, can see through sample. | At 90 hours, small amount of fouling material floating in sample. |

TABLE 2-continued

| Sample | 1-3 hours | 21-23 hours | 31-36 hours | 70+ hours |
|---|---|---|---|---|
| 3 | Clear | At 21 hours, clear, but darker. At 23 hours, slightly cloudy. | N/A | At 90 hours, fouling material floating in sample. |
| 4 | At 1 hour, slightly opaque, but better than CE-1. At 3 hours, opaque. | N/A | N/A | At 72 hours, fouling material floating in sample. |
| 5 | At 1 hour, clear. At 3 hours, opaque. | N/A | N/A | At 72 hours, fouling material floating in sample. |
| 6 | Clear | At 23 hours, slightly cloudy. | N/A | N/A |
| 7 | Clear | At 23 hours, fouling material floating in sample. | N/A | N/A |
| 8 | At 1 hour, clear. At 3 hours, opaque. | N/A | N/A | At 72 hours, fouling material floating in sample. |
| 9 | At 1 hour, clear. At 3 hours, opaque. | N/A | At 36 hours, fouling material floating in sample. | N/A |
| CE-3 | Clear | N/A | N/A | At 72 hours, fouling material floating in sample. |
| CE-4 | N/A | At 21 hours, opaque—fouling dispersed throughout sample. | N/A | N/A |
| CE-5 | At 1 hour, fouling. | N/A | N/A | N/A |
| CE-6 | At 1 hour, fouling. | N/A | N/A | N/A |
| CE-7 | At 1 hour, fouling. | N/A | N/A | N/A |

The antifoulant samples 1-9 show improved results over comparative examples CE-1, CE-2, CE-5, CE-6, CE-7 and the blank. In fact, CE-5, CE-6 and CE-7 did not show any efficacy against fouling. CE-3 does show clear results at hours 1-3, but requires a large amount of naphthalene sulfonate. The combination of hydroxylamine and naphthalene sulfonate have a synergistic effect on the prevention of fouling by aldol compounds.

While typical embodiments have been set forth for the purpose of illustration, the foregoing descriptions should not be deemed to be a limitation on the scope herein. Accordingly, various modifications, adaptations and alternatives may occur to one skilled in the art without departing from the spirit and scope herein.

The invention claimed is:

1. A method for inhibiting the formation of fouling materials comprising contacting hydrocarbon media containing carbonyl compounds with hydroxylamine and naphthalene sulfonate while treating the hydrocarbon media with a basic wash.

2. The method of claim 1 wherein the hydroxylamine is selected from the group consisting of hydroxylamine sulfate, hydroxylamine sulfite, hydroxylamine acetate, hydroxylamine nitrate and hydroxylamine hydrochloride.

3. The method of claim 2 wherein the basic wash is selected from the group consisting of sodium hydroxide, potassium hydroxide or alkanolamines and wherein the weight ratio of hydroxylamine to naphthalene sulfonate is from about 0.1:1 to about 20:1.

4. The method of claim 1 wherein the weight ratio of hydroxylamine to naphthalene sulfonate is from about 0.1:1 to about 20:1.

5. The method of claim 4 wherein the weight ratio of hydroxylamine to naphthalene sulfonate is from about 0.1:1 to about 10:1.

6. The method of claim 5 wherein the weight ratio is from about 0.4:1 to about 5:1.

7. The method of claim 5 wherein the weight ratio is from about 1:1 to about 10:1.

8. The method of claim 7 wherein the weight ratio is from about 1:1 to about 8:1.

9. The method of claim 1 wherein the combined dosage amount of hydroxylamine and naphthalene sulfonate is from about 0.1 ppm by weight to about 1000 ppm by weight based on the weight of the hydrocarbon media.

10. The method of claim 9 wherein the combined dosage amount of hydroxylamine and naphthalene sulfonate is from about 1 ppm by weight to about 100 ppm by weight, based on the weight of the hydrocarbon media.

11. The method of claim 10, wherein the combined dosage amount of hydroxylamine and naphthalene sulfonate is from about 1 ppm by weight to about 50 ppm by weight, based on the weight of the hydrocarbon media.

12. The method of claim 1 wherein the hydroxylamine is added to the hydrocarbon media simultaneously with the basic wash.

13. The method of claim 1 wherein the naphthalene sulfonate is added to the hydrocarbon media simultaneously with the basic wash.

14. The method of claim 1 wherein the hydroxylamine is added to the basic wash before contacting the hydrocarbon media.

15. The method of claim 1 wherein the naphthalene sulfonate is added to the basic wash before contacting the hydrocarbon media.

16. The method of claim 1 wherein the hydrocarbon media is a cracked hydrocarbon stream from the pyrolysis of hydrocarbons.

17. The method of claim 16 wherein the cracked hydrocarbon stream is from the pyrolysis of ethane, propane, butane, naphtha, gasoil or mixtures thereof.

18. The method of claim 1 wherein the basic wash is selected from the group consisting of sodium hydroxide, potassium hydroxide or alkanolamines.

19. A method for inhibiting the formation of fouling materials for at least 21 hours, the method comprising contacting hydrocarbon media containing carbonyl compounds with hydroxylamine and naphthalene sulfonate while treating the hydrocarbon media with a basic wash.

* * * * *